United States Patent [19]

van der Linden

[11] 4,361,986

[45] Dec. 7, 1982

[54] DEVICE FOR SURFACE MACHINING

[75] Inventor: Jacob A. van der Linden, Goes, Netherlands

[73] Assignee: Machinefabriek A. van der Linden B.V., Goes, Netherlands

[21] Appl. No.: 153,909

[22] Filed: May 28, 1980

[30] Foreign Application Priority Data

Jun. 5, 1979 [NL] Netherlands ..... 7904403

[51] Int. Cl.[3] ..... B24B 7/12; A47L 25/00

[52] U.S. Cl. ..... 51/34 R; 15/77

[58] Field of Search ..... 51/34 R, 34 H, 34 J, 51/34 K, 38, 39, 31, 61, 33 R; 15/21 D, 21 R, 77; 408/235; 74/590, 591, 589, 40

[56] References Cited

U.S. PATENT DOCUMENTS

| | | | |
|---|---|---|---|
| 2,269,197 | 1/1942 | Hamilton | 74/40 |
| 2,297,976 | 10/1942 | Nachtman | 15/77 |
| 2,563,301 | 8/1951 | Arms | 51/34 C |
| 2,819,618 | 1/1958 | Slusher | 74/590 X |
| 3,112,657 | 12/1963 | Huck | 74/590 |
| 3,335,593 | 8/1967 | Zeunert | 74/590 |

*Primary Examiner*—Stephen G. Kunin
*Assistant Examiner*—Robert A. Rose
*Attorney, Agent, or Firm*—Diller, Ramik & Wight

[57] ABSTRACT

A device for working the surfaces of objects, such as abrading and brushing machines and the like comprising a supporting surface for the object to be treated and at least one working member arranged at a distance from the supporting surface and rotatably driven about a shaft parallel to said supporting surface and being movable in an axial sense in a reciprocatory manner by driving means, wherein a counterweight is fastened to a rocking arm journalled in the frame of the device and linked pivotably to said working member, in order to damp the reciprocatory movement of the working member.

2 Claims, 3 Drawing Figures

DEVICE FOR SURFACE MACHINING

Figure 1:
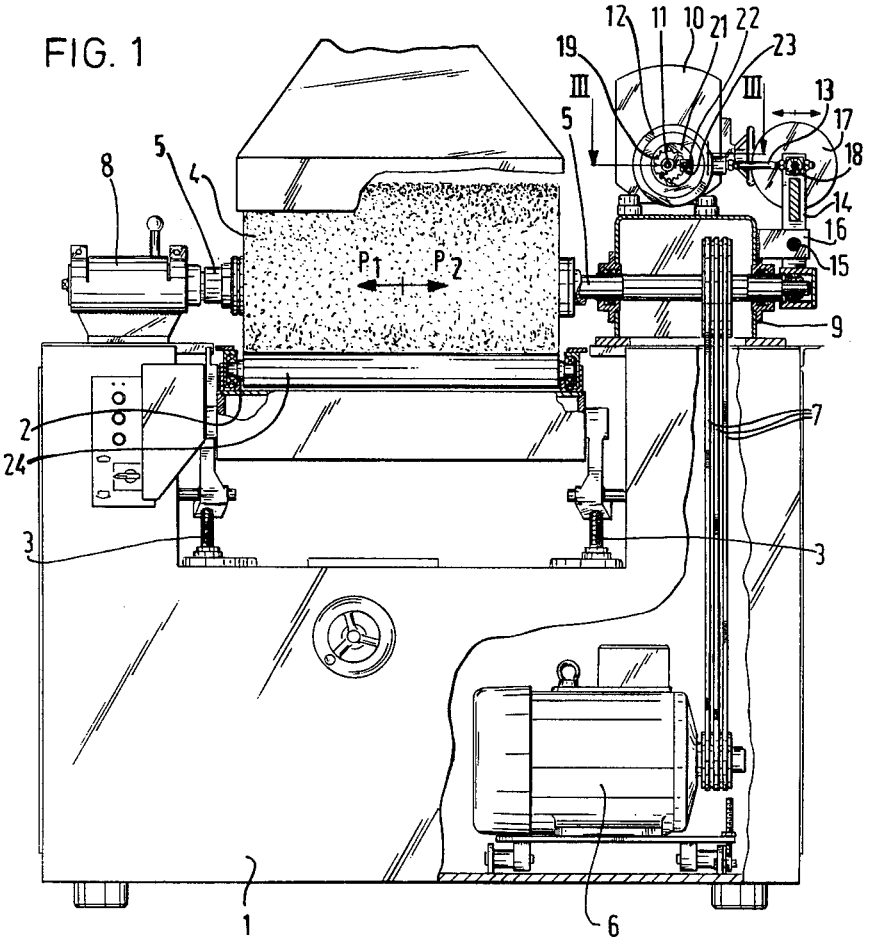

The invention relates to a device for working the surfaces of objects, such as abrading and brushing machines and the like comprising a supporting surface for the object to be treated and at least one working member arranged at a distance from the supporting surface and rotatably driven about a shaft parallel to said supporting surface and being movable in an axial sense in a reciprocatory manner by driving means.

In the surface finish of products, for example, by abrasion, grinding and brushing it is essential for the surface to be finished with a minimum degree of roughness. To this end various measures have been proposed, for example, the reciprocatory movement of the working member in an axial sense so that any irregularities in the working member will not be transferred to the surface to be machined. Particularly in the case of comparatively heavy working members the reciprocatory movement has the disadvantages that the machine frame tends to vibrate with this movement, which affects the treatment of the product.

The invention has for its object to obviate said disadvantage and provides a device which is characterized in that an element damping said reciprocatory movement of the working member is provided.

Preferably the damping element is constructed in the form of a counterweight, which performs a movement opposite that of the working member. In this way the reactive forces exerted on the frame are compensated so that the frame will not be deformed.

According to a further development of the idea of the invention the shaft of the working member is coupled with one end of a rocking arm journalled in the frame of the device, whereas the counterweight is fastened to the other end of said arm.

In a particularly simple embodiment the other end of the rocking arm is driven by driving means as a result of which a particularly compact structure is obtained.

The invention will be described more fully with reference to an embodiment shown in the accompanying drawing.

The drawing shows in

Figure 2:
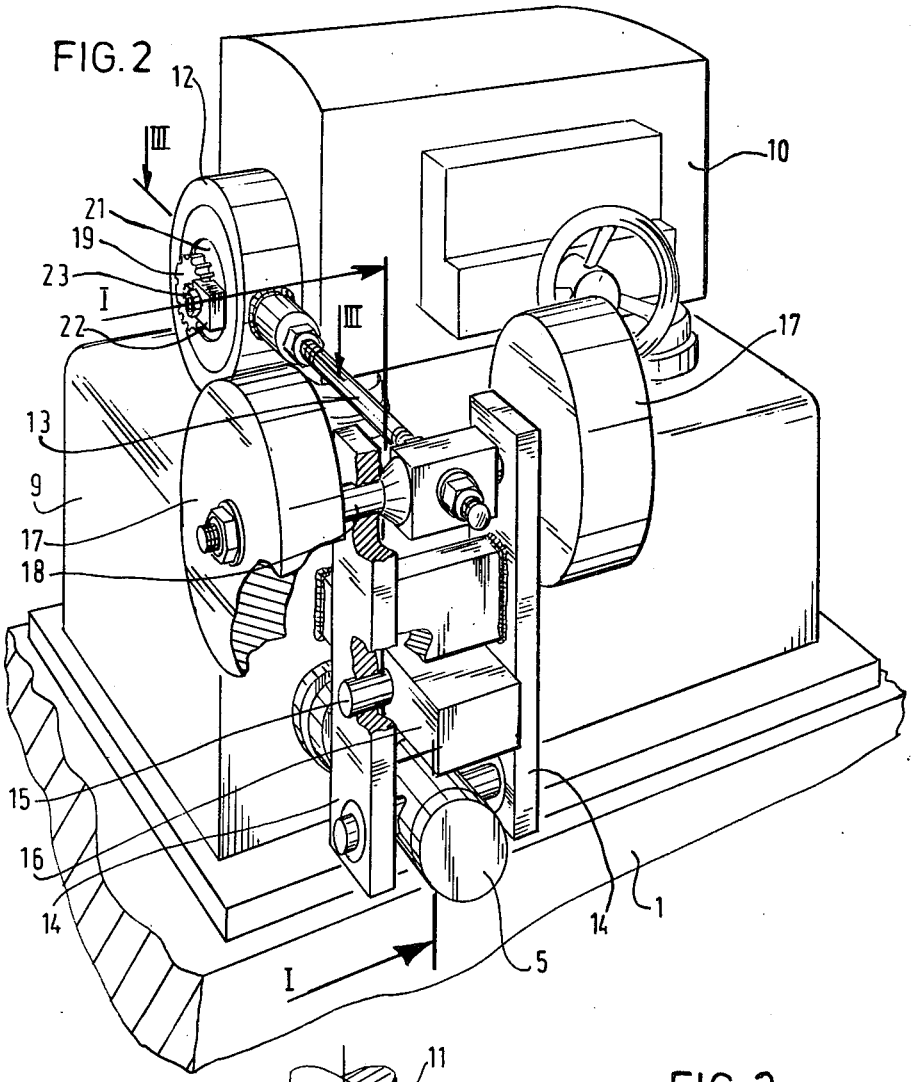
Figure 3:
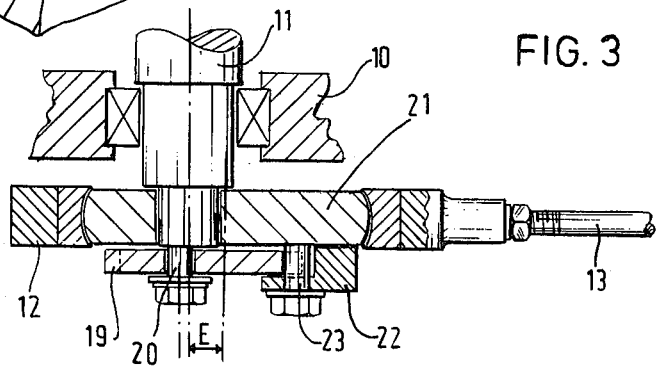

FIG. 1 a standing front view, partly a sectional view taken on the line I—I in FIG. 2 of a device, FIG. 2 a perspective view of the driving mechanism for the reciprocatory movement of the working member, FIG. 3 a sectional view of a detail taken on the line III—III in FIG. 2.

The device shown in the Figures mainly comprises a cabinet-like lower frame 1, the upper part of which supports a table-like carrier 2, which is displaceable in a direction of height with respect to the lower frame 1 by means of screw spindles 3.

At a distance above the table 2 is arranged a working member in the form of a brush 4, which is rotatably driven about a shaft 5 by an electric motor 6 arranged below in the cabinet 1 through a rope transmission 7. The shaft 5 is supported on both sides of the brush 4 on the one hand by a bearing bushing 8 and on the other hand by a bearing housing 9, both of which are fastened to raised consoles of the lower frame 1. The bearings are constructed so that a reciprocatory movement of the brush 4 in the direction of the arrows P1 and P2 respectively is allowed, the shaft 5 being slidable in an axial sense in the bearings.

On top of the bearing housing 9 is arranged a driving mechanism for performing the reciprocatory movement of the brush 4. This mechanism comprises an electric motor and a change-speed gear 10, provided at the output shaft 11 with an eccentric 12, with which is coupled a connecting rod 13. The connecting rod 13 is coupled with the top end of a rocking rod 14, which is rotatably fastened at 15 to a support 16 standing out with respect to the housing 9. The lower end of the rod 14 is coupled with the end of the shaft 5 (see FIG. 2).

In accordance with the invention compensation masses or counterweights 17 are provided near the top end of the rocking arm 14. These weights 17 are fastened to a shaft 18 projecting on both sides of the rocking arm 14 and being secured itself to the junction with the connecting rod 13.

FIG. 3 illustrates that the extent of eccentricity E can be adjusted by means of a toothed wheel 19, which can be clamped by means of a bolt 20 to the end of the output shaft 11. To a disc 21 of the eccentric fastened to the shaft 11 is secured a blocking member 22 by means of a bolt 23. It will be obvious that by turning the wheel 19 into the desired position and by blocking this position by means of the element 22 the eccentricity E or the deflection of the top end of the rocking arm 14 can be set and hence also the reciprocatory stroke of the brush 4.

The device described above operates as follows. The product to be machined is put down on the table 2 and passed below pressure rollers 24 arranged on the front and rear side of the brush 4.

Behind the pressure roller 24 shown in FIG. 1 the brush 4 comes into contact with the top surface of the product lying on the table 2. After the motor 6 is started, the brush 4 is rotated about the shaft 5 with a high speed and simultaneously moved in a reciprocatory manner by the drive of the motor unit 10 through the transmission 13, 14. The compensation masses 17 ensure that during this reciprocatory movement having a frequency of about 30 strokes a minute a substantially reaction-free rocking movement of the arm 14 at point 15 is obtained.

Therefore, no reactive forces will be transferred via the bearing housing 9 to the frame 1 or to the table 2 respectively. The invention is not limited to the embodiment described above. Within the scope of the invention the compensation masses 17 may, as an alternative, be arranged on the other side of the brush 4, the construction being substantially the same, whilst the compensation masses may be suspended at a lower level than the shaft 5.

What is claimed is:

1. A device for surface-machining a workpiece, which comprises a supporting framework including means supporting a workpiece for movement along a rectilinear path; a rotatable machining member having significant mass and means for rotating such machining member about an axis extending crosswise of said path but in spaced parallelism thereto so that said machining element engages an exposed surface of the workpiece as the workpiece moves along said path; means for reciprocating said machining member back and forth along said axis whereby the combined rotary and reciprocatory motion of the machining member effects surface-machining of said exposed surface of the workpiece; said means for reciprocating including a rocker arm pivotally connected to said machining member, bearing means pivotally mounting said rocker arm on said frame, and drive means for oscillating said rocker arm whereby said bearing means and consequently said supporting framework tends to be subjected to forces which cyclically reverse directions and vary in amplitude due to reciprocation of said significant mass of the machining member; and counterweight means attached to said rocker arm for counterbalancing said forces whereby the supporting framework is substantially free of vibration-inducing forces imposed through said bearing means due to reciprocation of the significant mass of said machining member, said drive means comprising a motor having a drive shaft, an eccentric on said drive shaft and a connecting rod journalled on said eccentric, there being a trunnion member having a journal pivotally carried by one end of said rocker arm, said trunnion being connected to said connecting rod and said counterweight means comprising at least one weight secured on said journal, a second trunnion pivotally carried by the other end of said rocker arm, said machining member being connected to said second trunnion and said bearing means being pivotally connected to said rocker arm between said trunnions.

2. A device as defined in claim 1 wherein said rocker arm is in the form of two parallel and spaced arms straddling said bearing means and said trunnions.

* * * * *